US007645957B2

(12) United States Patent
Capitanio et al.

(10) Patent No.: US 7,645,957 B2
(45) Date of Patent: Jan. 12, 2010

(54) NOZZLE FOR A GAS-INSULATED SWITCHING DEVICE AND RELATED SWITCHING DEVICE

(75) Inventors: Roberto Capitanio, Bergamo (IT); Carlo Cereda, Caravagglo (IT)

(73) Assignee: ABB Technology AG, Zurich (CH)

( * ) Notice: Subject to any disclaimer, the term of this patent is extended or adjusted under 35 U.S.C. 154(b) by 308 days.

(21) Appl. No.: 10/582,752

(22) PCT Filed: Dec. 17, 2004

(86) PCT No.: PCT/EP2004/014569

§ 371 (c)(1),
(2), (4) Date: May 2, 2007

(87) PCT Pub. No.: WO2005/059938

PCT Pub. Date: Jun. 30, 2005

(65) Prior Publication Data

US 2007/0278186 A1 Dec. 6, 2007

(30) Foreign Application Priority Data

Dec. 19, 2003 (EP) ..... 03079013

(51) Int. Cl.
*H01H 33/70* (2006.01)

(52) U.S. Cl. ..... 218/53; 218/63; 218/72

(58) Field of Classification Search ..... 218/43, 218/48–50, 53, 54, 62–65, 72–74
See application file for complete search history.

(56) References Cited

U.S. PATENT DOCUMENTS

| | | | | |
|---|---|---|---|---|
| 3,364,327 | A | 1/1968 | Cromer | |
| 3,665,134 | A * | 5/1972 | Fischer | 218/59 |
| 4,418,255 | A | 11/1983 | Hess et al. | |
| 4,420,662 | A * | 12/1983 | Niemeyer et al. | 218/53 |
| 4,445,019 | A * | 4/1984 | Gaupp et al. | 218/65 |
| 4,707,576 | A | 11/1987 | Gessinger et al. | |
| 5,216,214 | A | 6/1993 | Willieme et al. | |
| 5,939,692 | A | 8/1999 | Perret | |
| 6,483,064 | B2 | 11/2002 | Dufournet et al. | |

FOREIGN PATENT DOCUMENTS

| | | |
|---|---|---|
| DE | 880338 | 6/1953 |
| EP | 0524088 | 1/1993 |
| EP | 1544881 | 1/2006 |
| EP | 1544881 B1 | 1/2007 |
| WO | WO2005059938 | 3/2005 |

* cited by examiner

*Primary Examiner*—Renee S Luebke
*Assistant Examiner*—Marina Fishman
(74) *Attorney, Agent, or Firm*—Paul R. Katterle

(57) ABSTRACT

A nozzle for a medium or high voltage gas switching device of the type having at least a couple of separable arc contacts (1, 2), comprising a hollow shaped body (100) suitable to be positioned inside the device around the zone (20) where electric arcs form between said arc contacts (1, 2) during switching operations, characterized in that said hollow shaped body (100) has a first portion (101) electrically conductive and a second portion (102) made of electrically insulating material which surrounds at least partially said first portion (101).

13 Claims, 1 Drawing Sheet

NOZZLE FOR A GAS-INSULATED SWITCHING DEVICE AND RELATED SWITCHING DEVICE

CROSS-REFERENCE TO RELATED APPLICATIONS

This application is the national phase filing of International Application No. PCT/EP04/014569 filed on Dec. 17, 2004 published as WO2005/059938 which designated at least one country other than the United States of America ("the PCT Application") and the PCT Application claims the priority of European Application No. 03079013.3 filed on Dec. 19, 2003 ("the European Application") and the contents of the PCT Application and the Italian Application are relied upon and incorporated herein by reference in their entirety, and the benefit of priority under 35 U.S.C. 119 is hereby claimed.

BACKGROUND OF THE INVENTION

The present invention relates to a nozzle for a gas-insulated switching device for high- or medium-voltage applications, i.e. for voltages above 1000 Volt, and to a related switching device comprising such a nozzle.

As it is widely known in the art, gas insulated switching devices for high- and medium-voltage applications normally comprise a fixed arc contact and a mobile arc contact; it is also known that several types of gas switching devices for high- and medium-voltage applications may additionally have a so-called fixed main or permanent contact and a corresponding mobile main or permanent contact through which the current mainly passes when the gas switching device is in a closed position.

In both solutions, during opening/closing operations, usually electric arcs strike between the arcing contacts; a nozzle assembly is generally positioned around the arc contacts in order to delimit the arcing zone and to restrain the potentially negative effects of such electric arcs. By means of the nozzle assembly, a sufficient flow of gas is obtained in the arcing zone so as to cool the arcing contacts sufficiently and remove heat; thus, circuit breaking is enabled to be performed over the entire required interruption window and for currents going up to the short-circuit breaking capacity.

Examples of existing nozzles are disclosed in patent documents U.S. Pat. No. 6,483,064, U.S. Pat. No. 5,216,214 and EP 0524088.

At present, known nozzle assemblies have some drawbacks, as regard in particular to their constructive structure, manufacturing, and mounting in switching devices as well.

Indeed, known nozzle assemblies are generally realized by means of several different pieces, mainly a converging-diverging body, made of insulating material, a so-called puffer cap, and other additional components for realizing the mechanical connections. In particular, the insulating body is generally realized by using a cylinder of raw material which is machined, e.g. with a lathe, so as to obtain the desired shape; alternatively, the raw material is first preformed, thus achieving a rough shape, and then machined with suitable tools. In both cases a lot of raw materials is wasted and machining is usually difficult and time consuming.

Hence, costs and manufacturing time are not optimized, whilst assembly inside the switching device, due to the use of different pieces, is rather cumbersome and mechanically complicated. In particular, when the main contacts are present, the nozzle assembly is mounted by means of mechanical connection means on the mobile equipment of the main mobile contact, as described, for example in U.S. Pat. No. 5,939,692; in addition to being more complicated, this solution is clearly not suitable when the switching device has only the arc contacts, thus forcing to adopt different constructive solutions and lacking in flexibility. Finally, gas switching devices for high- and medium-voltage applications may further comprise an electrically conductive shield, positioned externally to and operatively associated with the nozzle assembly, in order to optimize the electric field distribution in the arcing zone and in its surroundings. Therefore, also this function is usually performed by means of an additional dedicated component and results in a non-optimized space occupation inside the device.

Alternatively, when the main contacts are present, the mobile main contact is machined so as it has a shape which performs the shielding function; in this case, particular care must be taken when shaping the contacts and assembling them on the structure of the switching device in order to avoid damages. This clearly results in a strong complication in the machinery of the mobile main contact and in assembling the switching device, with a consequent increase in manufacturing time and cost.

BRIEF SUMMARY OF THE INVENTION

In accordance with the present invention, a gas switching device for high and medium voltage applications is provided. The gas switching device includes at least a mobile arc contact, a corresponding fixed arc contact and a nozzle having a hollow shaped body which is positioned inside the device around a zone where electric arcs form between the arc contacts during switching operations. The hollow shaped body has an electrically conductive first portion and a second portion made of electrically insulating material which at least partially surrounds the first portion. The hollow shaped body is mechanically secured directly onto the mobile arc contact by conductive connecting means which is configured so as to electrically connect the mobile arc contact to the first portion.

BRIEF DESCRIPTION OF THE DRAWING

Further characteristics and advantages will become apparent from the description of some preferred but not exclusive embodiments of a nozzle according to the invention, illustrated only by way of non-limitative examples with the accompanying drawing of FIG. 1 which is a sectional plan view schematically illustrating the nozzle according to the invention used inside the interruption unit of a circuit breaker.

DETAILED DESCRIPTION OF THE INVENTION

Figure 1:
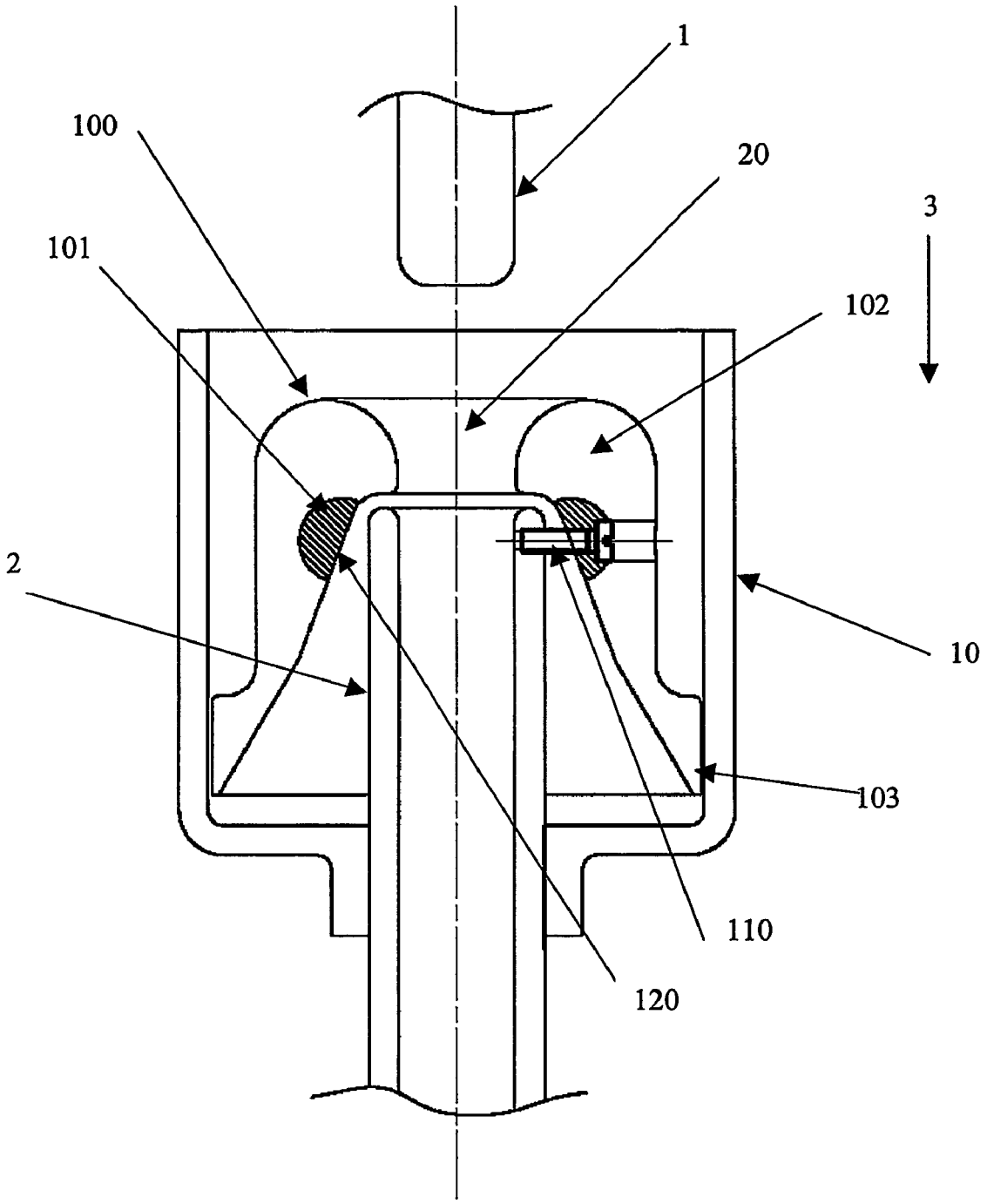

The nozzle according to the invention is particularly suitable for use in medium or high voltage circuit breakers and will be described by making reference to its use with such a type of switching devices, without intending however to limit in any way its possible applications. FIG. 1 schematically illustrates part of the interruption equipment of a circuit breaker in an open position; as shown, said circuit breaker comprises a puffer chamber 10, a fixed arc contact 1, realized for example by means of a conducting rod, a mobile arcing contact 2, constituted for example by a hollow metallic tube, which is operatively connected to suitable actuation means (not illustrated) devised to displace the mobile arc contact during operations from a first position in which it is electrically coupled to the fixed arc 1, and a second position where it is separated therefrom. The interruption equipment is normally placed inside a casing (not illustrated), made for example of porcelain or other suitable polymeric composite materials, which is filled with insulating gas, e.g. $SF_6$.

In normal operating conditions, the two arc contacts 1 and 2 are electrically coupled with the head of the fixed contact 1 housed inside the tubular body of the mobile arc contact 2; if opening of the breaker occurs (direction of the mobile equipment along the arrow 3), an electric arc normally strikes at the zone 20 where the two arcing contacts start to separate; a suitable nozzle is positioned around the zone 20 where the arcs strike in order to quench and restrain their effects.

Advantageously, the nozzle according to the invention comprises a hollow shaped body 100, preferably having a substantially cylindrical symmetry, and comprising a first portion 101 electrically conductive, and a second portion 102 which is made of substantially electrically insulating material that surrounds at least partially the first portion 101.

According to a preferred embodiment, the nozzle is constituted by a unique integral body with the first portion 101 incorporated in the second portion 102.

Further, the first portion 101 is advantageously shaped so as to act as an electric shield; in particular, the first portion 101 has preferably a substantially annular shape, for example a shaped annular body or a shaped ring, placed at an inner circumference of the hollow body, and the second portion 102 surrounds the first portion 101 without fully enclosing it, i.e. it is shaped so as the internal boundary surface 120 of the annular body is not in contact with the second portion but is left uncovered. This allows to have a smooth electrical field distribution between the open arcing contacts and its surroundings, and to optimize the shielding function according to a simple and functionally optimized solution.

The second portion 102 has a lower tip part 103 which has a shaped profile so as to act as a puffer cap, i.e. during opening it acts as a piston and compresses the gas inside the chamber 10, thus allowing flow of the gas through the nozzle itself.

Preferably, the second portion 102 is made of moldable insulating material, such as a thermoplastic resin able to withstand high temperature and pressure conditions; in this way, the second portion 102 of the nozzle body according to the invention can be advantageously manufactured by direct injection molding, that allows to properly shaping the second portion in a relatively easy and cost-effective way.

Proper moldable insulating materials for the second portion 102 are for example fluorine based compounds, preferably a fluorinated co-polymer ethylene-propylene, commercially known as FEP, or perfluoroalkoxy polymers, commercially known as PFA, both produced by DuPont or by Dyneon, or mixtures thereof. Particularly suitable for being used in the second portion 102 are materials of the family of PFA which comprise co-polymer of tetrafluoroethylene and a perfluoropropylvinilether, commercially known as Hyflon PFA, or a perfluoromethylvinylether, commercially known as Hyflon MFA, both produced by Solvay. In a preferred embodiment, the first portion 101 is also realized by using a moldable conductive material, and comprises an insulating matrix and a filler. The insulating matrix is realized by means of a material selected from those above indicated for the second portion 102, e.g. FEP, PFA, or mixtures thereof; advantageously, both portions 101 and 102 are realized using the same moldable insulating material.

In turn, the filler is made of one or more electrical conductive materials, for example graphite or carbon or superconductive carbon or mixtures thereof, preferably in form of powder or grains of proper dimensions, chosen in the range from nanometers to millimeters. In order to ensure a proper conductivity and stability of the material, the volume of the filler is chosen in the range between 0.1% and 40%, of the total volume of the first portion, preferably between 0.5% and 35%, more preferably between 1% and 30%.

According to this embodiment, the nozzle is preferably manufactured by co-injection molding of the materials forming the two portions in a unique mold; this allows to manufacture the nozzle according to a process which is extremely simple and at lower cost with respect to known solutions.

Alternatively, the first portion 101 can be made completely of a metallic annular piece; according to this solution, the nozzle is manufactured positioning in a mold the first portion 101 and then injecting the moldable insulating material of the second portion 102 directly thereon.

As previously mentioned, the nozzle according to the invention is suitable for applications with different types of high- or medium voltage gas insulated switching devices, in particular circuit breakers; accordingly, the present invention also relates to a high- or medium voltage gas insulated switching device comprising a nozzle as previously described.

As mentioned above, the nozzle is positioned around the arc contacts 1 and 2, i.e. when they are in electrical coupling, in order to delimit the zone 20 where the electric arcs form between them during opening and closing operations; according to a particularly preferred embodiment, shown in FIG. 1, the nozzle is mechanically secured directly onto the mobile arc contact 2 by means of connecting means 110. In this way, assembly steps are significantly simplified with respect to known solutions; further, this solution is independent from the presence of the so-called main or permanent contacts, thus resulting in a greater flexibility of applications and reduction of overall production costs.

Preferably, the nozzle is mechanically secured directly onto the mobile arc contact 2 by means of conductive connecting means 110, e.g. metallic screw means or nails or rivets, which are advantageously configured and positioned so as to electrically connect the first portion 101 with the arc contact 2; in this way the conductive part of the nozzle is at the same voltage of the mobile arc contact 2, thus allowing the electric shielding action.

In this way, the connecting means 110 perform at the same time both mechanical and electrical functions, with a consequent further simplification in realizing and assembling the switching device, according to an extremely compact constructive solution.

In practice, it has been found that the nozzle according to the present invention fully achieves the intended aim and objects, giving several advantages with respect to prior art solutions. In fact, as previously described, the nozzle is realized by a unique body which, thanks to its innovative structure, is able to perform several functions which in the prior art are instead performed by several different elements; in particular, the nozzle according to the present invention is able to work at the same time, not only as part an arc quenching element, but also as an electric shield, and also as a puffer cap. Further, it can be realized by means of extremely simplified manufacturing operations, thus obtaining significant savings in terms of material, time and production costs.

Finally, its assembling inside a gas-switching device, and connections with the other components of it, are very simple, functionally effective and fast with an optimized internal space occupation. This results in an overall improved switching device.

The nozzle and the related switching device thus conceived, are susceptible of modifications and variations, all of which are within the scope of the inventive concept; all the details may furthermore be replaced with technically equivalent elements. For example the electrically conductive portion could be completely incorporated inside and fully covered by the second portion 102. In practice, the materials used, so long as they are compatible with the specific use, as well as the dimensions, may be any according to the requirements and the state of the art.

The invention claimed is:

1. A gas switching device for high and medium voltage applications, comprising: at least a mobile arc contact and a corresponding fixed arc contact, and a nozzle having a hollow shaped body which is positioned inside the device around a zone where electric arcs form between said arc contacts during switching operations, said hollow shaped body having a first portion electrically conductive and a second portion made of electrically insulating material which surrounds at least partially said first portion, wherein said hollow shaped body is mechanically secured directly onto said mobile arc contact by conductive connecting means which is configured so as to electrically connect said mobile arc contact to said first portion.

2. The gas switching device according to claim 1, wherein said second portion has a lower tip part which has a shaped profile so as to act as a puffer cap.

3. The gas switching device according to claim 1, wherein said hollow shaped body is a single body with said first portion incorporated in said second portion.

4. The gas switching device according to claim 1, wherein said first portion is shaped so as to act as an electric shield.

5. The gas switching device according to claim 1, wherein said first portion has a substantially annular shape and is positioned along an inner circumference path of the hollow shaped body.

6. The gas switching device according to claim 1, wherein said first portion and/or said second portion comprise moldable materials.

7. The gas switching device according to claim 6, wherein said first portion is made of a matrix of substantially moldable insulating material and a conductive filler.

8. The gas switching device according to claim 7, wherein the volume of said filler is in the range between 0.1% and 40% of the total volume of said first portion.

9. The gas switching device according to claim 7, wherein the volume of said filler is in the range between 0.5% and 35% of the total volume of said first portion.

10. The gas switching device according to claim 7, wherein the volume of said filler is in the range between 1% and 30% of the total volume of said first portion.

11. The gas switching device according to claim 1, wherein the said first portion is substantially made of a metallic piece.

12. The gas switching device according to claim 1, wherein the conductive connecting means comprises a screw.

13. The gas switching device according to claim 1, wherein the conductive connecting means comprises a rivet.

* * * * *